United States Patent [19]
Alexander et al.
[11] 4,456,492
[45] Jun. 26, 1984

[54] MELT EXPLOSIVE COMPOSITION

[75] Inventors: Roger D. Alexander, Montmorency; Andrew J. Bates, Ascot Vale, both of Australia

[73] Assignee: ICI Australia Limited, Melbourne, Australia

[21] Appl. No.: 447,136

[22] Filed: Dec. 6, 1982

[30] Foreign Application Priority Data

Dec. 23, 1981 [AU] Australia ..... PF2073

[51] Int. Cl.[3] ..... C06B 45/34

[52] U.S. Cl. ..... 149/8; 149/41; 149/43; 149/44; 149/46; 149/61; 149/76; 149/85

[58] Field of Search ..... 149/8, 41, 43, 44, 46, 149/61, 76, 85

[56] References Cited

U.S. PATENT DOCUMENTS 4,134,780 1/1979 Barnett ..... 149/40

4,248,644 2/1981 Healy ..... 149/2 X

*Primary Examiner*—Stephen J. Lechert, Jr.
*Attorney, Agent, or Firm*—Cushman, Darby & Cushman

[57] ABSTRACT

This invention concerns a melt explosive composition which comprises as a first component a melt which is pourable, pumpable or flowable at a temperature in the range of from −10° C. to +90° C. and which comprises at least one oxygen-releasing salt, for example ammonium nitrate, and at least one melt-soluble fuel material, for example urea, and as a second component oiled prills of ammonium nitrate. The explosive composition offers the advantage of utilizing relatively inexpensive fuel oil as a secondary fuel in a melt explosive composition without loss of detonation sensitivity of the composition on storage. The explosive compositions also show good retention of detonation sensitivity under conditions of applied static pressure, for example, in deep boreholes.

30 Claims, No Drawings

MELT EXPLOSIVE COMPOSITION

This invention relates to explosive compositions and in particular to melt explosive compositions comprising an oxygen-releasing salt, a melt soluble fuel and, as a secondary fuel, an oil.

Solid and/or cast melt explosive compositions comprising as a major constituent an oxygen-releasing salt such as ammonium nitrate have been known for many years. However, while such compositions are in many aspects satisfactory as explosives they suffer from the disadvantage that it has been found difficult in practice to load them into boreholes at commercially acceptable loading rates to give the packing density and homogeneity required to achieve the desired blast energy.

In order to overcome these deficiencies of solid melt explosive compositions it has been proposed to use water bearing explosive compositions which in general terms comprise a mixture of an oxygen-releasing salt material, fuel material and water in proportions such that the compositions are pourable or pumpable. These compositions, often referred to as slurry explosives or water-gel explosives, have proved very useful but they suffer from the disadvantage that the water content required to make the composition pourable or pumpable acts as a diluent which contributes little to the energy which becomes available when the composition is detonated.

More recently the use of low melting point melt explosive compositions has been proposed in order to provide a pourable or pumpable explosive composition which is not diluted by an appreciable amount of water. In U.S. Pat. Nos. 3,926,696 and 3,996,078 there are described explosive compositions comprising eutectic mixtures which are characterized in that they have solidification points below +10° C. and preferably below −10° C. However, each of the compositions disclosed in these patents comprises as a sensitizer a highly explosive, hazardous chemical such as a nitrate or a perchlorate salt of an amine or an alkanolamine.

In U.S. Pat. No. 4,134,780 there is disclosed a relatively low melting point melt explosive composition which is pourable, pumpable or flowable and which overcomes the disadvantage of using a highly explosive, hazardous chemical as a sensitizer.

Even with the recent significant increases in the prices of petroleum products, oil is still one of the most economic fuels which can be used to provide oxygen balance in explosive compositions. Therefore, the use of oil as part of the fuel in melt explosive compositions can provide significant economic advantages by reducing the amount of more expensive fuels which are required for oxygen balance.

In U.S. Pat. No. 4,134,780 there is disclosed the use of fuel oil as a secondary fuel in relatively low melting point melt explosive compositions. In this patent the preparation of melt explosive compositions comprising fuel oil as a secondary fuel is taught wherein the fuel oil is added to and mixed into a thickened melt comprising an oxygen-releasing salt and a salt soluble fuel. These explosive compositions are eminently suitable for many applications and especially those applications in which a bulk explosive composition is required which can be mixed on site, transferred to boreholes as required, and detonated. However, fuel oil is not a melt soluble fuel and it has been found that these compositions suffer the disadvantage that on storage the fuel oil tends to separate from the melt resulting in a decrease in sensitivity of the explosive composition.

It has now been found that oil may be used as a secondary fuel in melt explosive compositions comprising an oxygen-releasing salt and a melt soluble fuel, without the disadvantage of a reduction in sensitivity on storage of the composition, by adsorbing the oil onto prilled ammonium nitrate and adding the oiled prills of ammonium nitrate to the melt.

Accordingly the present invention provides a melt explosive conposition comprising as a first component a melt which assumes a molten form at a temperature in the range of from −10° C. to +90° C. and which comprises at least one oxygen-releasing salt and at least one melt-soluble fuel material and a second component comprising oiled prills of ammonium nitrate.

Suitable oxygen-releasing salts for use in the first component of the compositions of the present invention include the alkali and alkaline earth metal nitrates, chlorates and perchlorates, ammonium nitrate, ammonium chlorate, ammonium perchlorate and mixtures thereof. The preferred oxygen-releasing salts include ammonium nitrate, sodium nitrate and calcium nitrate. More preferably the oxygen-releasing salt comprises ammonium nitrate or a mixture of ammonium nitrate and sodium nitrate.

Typically the oxygen-releasing salt component of the compositions of the present invention comprises from 50 to 90% and preferably from 70 to 85% by weight of the total composition. In compositions wherein the oxygen-releasing salt comprises a mixture of ammonium nitrate and sodium nitrate the preferred composition range for such a blend is from 5 to 25 parts of sodium nitrate for every 100 parts of ammonium nitrate. Therefore, in the preferred compositions of the present invention the oxygen-releasing salt component comprises from 70 to 85% by weight (of the total composition) ammonium nitrate or a mixture of from 5 to 20% by weight (of the total composition) sodium nitrate and from 50 to 80% by weight (of the total composition) ammonium nitrate.

The term "melt soluble fuel material" is used herein to mean a fuel material of which at least a part, and preferably all, is capable of forming a eutectic mixture with at least a part of the oxygen-releasing salt component, the melting point of the eutectic mixture being less than the melting point of either the fuel material or the oxygen releasing salt component. It is desirable that the melt soluble fuel material be capable of forming a miscible melt with ammonium nitrate since this component is a preferred oxygen releasing salt. Thus in the preferred compositions of the present invention, which contain ammonium nitrate, the melt soluble fuel material, hereinafter referred to as the primary fuel, may be defined as organic compounds which form an homogenous, eutectic melt with ammonium nitrate at temperatures up to 90° C. and which are capable of being oxidized by ammonium nitrate to gaseous products. The primary fuel may be a single compound or a mixture of two or more compounds. Suitable primary fuels for use in the first component of the compositions of the present invention include carboxylates, thiocyanates, amines, imides or amides. Suitable examples of useful primary fuels include urea, ammonium acetate, ammonium formate, ammonium thiocyanate, hexamethylenetetramine, dicyandiamide, thiourea, acetamide and mixtures thereof. Urea is a preferred primary fuel.

Typically, the primary fuel component of the compositions of the present invention comprises from 3 to 30% and preferably from 10 to 25% by weight of the total composition.

Preferably the first component of the composition of the present invention comprises 10 to 90%, and more preferably 40 to 90%, by weight of the total composition.

The term "oiled prills of ammonium nitrate" is used herein to mean prills of ammonium nitrate having adsorbed thereon typically from 1.0 to 10.0% w/w, and preferably from 3.0 to 7.0% w/w, of an oil. Suitable oils may be chosen from fuel oil, diesel oil, kerosene, naphtha, waxes, paraffins, asphaltic materials, polymeric oils such as the low molecular weight polymers of olefins, animal oils, fish oils and vegetable oils, and other mineral, hydrocarbon or fatty oils, and mixtures thereof. Preferred oils include hydrocarbon oils and particularly fuel oils such as diesel fuel oil.

Typically, the second component of the compositions of the present invention comprises from 10 to 90% by weight of the total composition.

The oil adsorbed on the ammonium nitrate prills, which comprise the second component of the compositions of the present invention, acts as a part of the fuel in the explosive compositions of the present invention. If desired, other, optional fuel materials which are not melt soluble, hereinafter referrred to as secondary fuel materials, may be incorporated into the compositions of the present invention. Suitable secondary fuel materials include solid carbonaceous materials and finely divided elements. Examples of suitable carbonaceous materials include comminuted coke or charcoal, carbon black, resin acids such as abietic acid, sugars such as glucose or dextrose and other vegetable products such as starch, nut meal or wood pulp. Other types of suitable secondary fuel materials which may be incorporated into the compositions of the present invention include finely divided elements such as sulfur, silicon and metals. Finely divided aluminium is a particularly preferred secondary fuel material.

Typically, the optional secondary fuel component of the compositions of the present invention comprises from 0 to 10% by weight of the total composition.

If desired the compositions of the present invention may also comprise a thickening agent which optionally may be crosslinked. The thickening agents, when used in the compositions of the present invention, are suitably polymeric materials, especially gum materials typified by the galactomannan gums such as locust bean gum or guar gum or derivatives thereof such as hydroxypropyl guar gum. Other useful, but less preferred, gums are the so-called biopolymeric gums such as the heteropolysaccharides prepared by the microbial transformation of carbohydrate material, for example the treatment of glucose with a plant pathogen of the genus Xanthomonas typified by *Xanthomonas campestris.* Other useful thickening agents include synthetic polymeric materials and in particular synthetic polymeric materials which are derived, at least in part, from the monomer acrylamide.

Typically, the optional thickening agent component of the compositions of the present invention comprises from 0 to 2% by weight of the total composition.

As indicated above, when used in the compositions of the present invention, the thickening agent optionally may be crosslinked. It is convenient for this purpose to use conventional crosslinking agents such as zinc chromate or a dichromate either as a separate entity or as a component of a conventional redox system such as, for example, a mixture of potassium dichromate and potassium antimony tartrate.

Typically, the optional crosslinking agent component of the compositions of the present invention comprises from 0 to 0.5% and preferably from 0 to 0.1% by weight of the total composition.

In many instances it has been found that the successful use of thickening agents in the compositions of the present invention does not require the presence of water. However, if it is considered desirable to enhance the performance of the thickening agents or their crosslinking, small amounts of water or a water-bearing medium may be incorporated into the compositions of the invention.

The explosive compositions of the present invention may also comprise a discontinuous gaseous phase as a means of controlling their density and sensitivity. The gaseous phase may be incorporated into the compositions of the present invention in the form of hollow particles, often referred to as microballoons, porous particles, or as gas bubbles homogeneously dispersed throughout the composition. Examples of suitable hollow particles include phenol-formaldehyde, urea-formaldehyde and glass, hollow microspheres. Examples of porous particles include expanded perlite.

Gas bubbles may be incorporated into the compositions of the invention by mechanical agitation, injection or bubbling the gas through the composition, or by in situ generation of the gas by chemical means. Suitable chemicals for the in situ generation of gas bubbles include peroxides such as, for example, hydrogen peroxide, nitrites such as, for example, sodium nitrite, nitrosoamines such as, for example, N,N'-dinitrosopentamethylenetetramine, alkali metal borohydrides such as, for example, sodium borohydride, and carbonates such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent.

By the incorporation of the appropriate volume of discontinuous gaseous phase, compositions of the present invention may be made which have densities as low as 0.30 g/cc. Very low density compositions may be of particular utility when a low explosive energy/volume explosive is required such as, for example, when minimal backbreak is required during open pit blasting.

The explosive compositions of the invention which incorporate gas bubbles, and particularly pumpable explosive compositions of the invention which incorporate gas bubbles, are liable to density increase and desensitization because of gas bubble disengagement on standing for any length of time in a molten or fluid state, and particularly during pumping. Therefore, the explosive compositions of the present invention which incorporate gas bubbles preferably also include a foam stabilizing surfactant of the type described in Australian Patent Application No. 68,707/81. Preferred foam stabilizing surfactants include primary fatty amines such as, for example, $C_6$ to $C_{22}$ alkylamines, $C_6$ to $C_{22}$ alkenylamines and mixtures thereof, and their ethoxylate derivatives.

In those explosive compositions of the present invention which incorporate gas bubbles and a foam stabilizing surfactant it is necessary to add more than 2.0% w/w of foam stabilizing surfactant to the compositions to achieve the desired foam stabilizing effect. While higher proportions of surfactant will stabilize the foam, for reasons of economy it is desirable to keep the proportion of the foam stabilizing surfactant to the minimum required to have the desired effect. The preferred level of foam stabilizing surfactant is in the range of from 0.3 to 1.5% by weight of the total composition.

The explosive compositions of the present invention may also comprise an additive to improve their sensitivity to detonation. Condensates of formaldehyde and naphthalenesulfonic acids and $C_1$ to $C_{10}$-(alkyl)naphthalenesulfonic acids and the alkali and alkaline earth metal salts thereof, hereinafter referred to as formaldehyde-naphthalenesulfonate condensates, have been found to be particularly effective in improving the sensitivity of the melt explosive compositions of the present invention. Examples of such formaldehyde-naphthalenesulfonate condensates include sulfonates in which two, three or more naphthalenesulfonate or alkylnaphthalenesulfonate moieties are joined together by methylene groups in what amounts to a low degree condensation polymer. Preferred naphthalenesulfonate derivatives include alkali metal salts of condensates of formaldehyde and naphthalenesulfonic acids such as, for example, alkali metal salts of methylenebis(naphthalene-$\beta$-sulfonate). The reason for the improved sensitivity and hence small critical charge diameter is not completely understood. However, while the theory should not be regarded as limiting, it is believed that the formaldehyde-naphthalenesulfonate condensates may modify the crystal habit of at least a portion of the oxygen-releasing salt.

It is not necessary to incorporate more than 2% by weight of the formaldehyde-naphthalenesulfonate condensate component in the explosive compositions of the present invention to achieve the desired improvement in sensitivity. However, while higher proportions of the formaldehyde-naphthalenesulfonate condensate component may be used, for reasons of economy it is desirable to keep the proportion of the formaldehyde-naphthalenesulfonate condensate to the minimum required to give the desired effect. Typically the formaldehyde naphthalenesulfonate condensate comprises from 0.01 to 5.0% by weight of the total composition and preferably from 0.1 to 2.0% by weight of the total composition.

In a further aspect the invention provides a process for the manufacture of a melt explosive composition comprising as a first component a melt which is pourable, pumpable or flowable at a temperature in the range of from −10° C. to +90° C. and which comprises at least one oxygen-releasing salt and at least one melt-soluble fuel material and a second component comprising oiled prills of ammonium nitrate, which process comprises forming a melt comprising the first component at a temperature in the range of from −10° C. to +90° C. and incorporating into said melt the second component.

In the preparation of a preferred melt explosive composition of the invention which comprises: oxygen-releasing salts such as, for example, ammonium nitrate and sodium nitrate; a melt soluble fuel such as, for example, urea; a formaldehyde-naphthalenesulfonate condensate such as, for example, disodium methylenebis(-naphthalene-$\beta$-sulfonate); a thickening agent such as, for example, guar gum; oiled prills of ammonium nitrate; optionally, a crosslinking agent such as, for example, sodium dichromate; optionally, a secondary fuel material such as aluminium powder; and, optionally, gas bubbles and a foam-stabilizing surfactant such as, for example, octadecylamine; it is preferred to prepare a melt comprising the oxygen-releasing salt, the melt-soluble fuel, the formaldehyde-naphthalenesulfonate condensate and the thickening agent, to add to this melt the oiled prills of ammonium nitrate, any crosslinking agent, any secondary fuel, and, if required, any foam-stabilizing surfactant, and, if desired, to introduce the gas bubbles either by the incorporation of an in situ chemical gassing agent or by mechanical aeration.

The temperature at which the mixture of the oxygen-releasing salt and the melt soluble fuel material forms a melt will vary dependent to some extent on the nature of the components and their proportions used to make the melt. As hereinbefore indicated the temperature at which the melt is formed lies in the range of from −10° C. to +90° C. By judicious choice of the components and their proportions it is possible to form melts having a wide range of melt-formation temperatures. For example, a mixture of 5 parts by weight of urea, 3 parts by weight of ammonium acetate, 2 parts by weight of acetamide and 10 parts by weight of ammonium nitrate will form a melt when heated to a temperature of 35° C. A mixture of ammonium nitrate, urea, ammonium acetate and ammonium formate in a weight ratio of 8:6:3:3 is fluid at a temperature of −10° C. while the same components in a weight ratio of 9:6:2:3 are liquid at a temperature of 20° C. Mixtures of ammonium nitrate and urea in a weight ratio of 53:47 having a melting point of about 45° C. while mixtures of ammonium nitrate, sodium nitrate and urea in a weight ratio of 468:97:435 have a melting point of about 35° C., and such mixtures are illustrative of melts comprising a single melt soluble fuel material. In the interests of safety and economy it is preferred to utilize melts which can be formed by heating at a temperature not in excess of 70° C.

Those melt explosive compositions of the present invention in which the major proportion of the composition, and preferably from 60 to 90% by weight of the composition, comprises the first component of the composition may be pumpable and therefore eminently suitable for use in conjunction with conventional pumping or mixing trucks designed for use with known water based explosives of the so-called aqueous slurry type. For example, the thickened melt component of such a composition of the present invention may be placed in the solution tank of such a conventional mixing truck and the residual components of the composition may be added to and mixed with the melt in a conventional manner and the resulting composition of the present invention may be transferred to a borehole ready for detonation. Such explosive compositions of the present invention may also be used as fillings for explosive cartridges and therefore may be utilized as packaged explosives.

Those melt explosive compositions of the present invention in which a substantial proportion of the composition, and typically from 30 to 90% by weight of the composition, comprises the second component of the composition may be loaded into boreholes by pouring, by using an auger or by other conventional techniques known in the art. Such explosive compositions of the present invention may also be used as fillings for explosive cartridges and therefore may be utilized as packaged explosives.

The melt explosive compositions of the present invention offer significant advantages over prior art melt explosive compositions. The explosive compositions provide a means for utilizing relatively inexpensive fuel oil as a secondary fuel in a melt explosive composition without loss of detonation sensitivity of the composition on storage. Moreover, the explosive compositions of the present invention also show the advantage of good retention of detonation sensitivity under conditions of applied static pressure, conditions encountered in deep boreholes.

The invention is now illustrated by, but is not limited to, the following Examples in which all parts and percentages are expressed on a weight basis unless otherwise specified.

EXAMPLE 1

Into an insulated vessel fitted with stirring means and heating means and connected to a pumping and delivery means there was added ammonium nitrate (432 parts), sodium nitrate (100 parts), urea (184 parts), water (22.5 parts), acetic acid (2 parts), thiourea (0.1 parts), octadecylamine (2.9 parts), and disodium methylene-bis(-naphthalene-$\beta$-sulfonate) (3.8 parts). The contents of the vessel were stirred and melted by heating to a temperature of 65° C. and guar gum (2.6 parts) was stirred into the melt to provide a thickened melt. Stirring of the melt was continued and then there was added thereto oiled ammonium nitrate prills (250 parts containing 6% w/w of adsorbed fuel oil). On completion of the mixing, samples of the explosive composition were pumped by the pumping means through the delivery means to simulated cylindrical boreholes in the form of cylindrical cardboard tubes and were allowed to cool to form a solid. Samples prepared in this way and stored for three months under ambient conditions could be detonated using a 140 g pentolite booster and showed no decrease in bubble energy in comparison to freshly prepared samples.

EXAMPLE 2

Into an insulated vessel fitted with stirring means and heating means and connected to a pumping and delivery means there was added ammonium nitrate (576 parts), sodium nitrate (133 parts), urea (245 parts), water (30 parts), acetic acid (4 parts), "Armeen" HT (4 parts; "Armeen" is a Trade Mark and "Armeen" HT is a primary fatty amine), thiourea (0.2 parts) and disodium methylene-bis(naphthalene-$\beta$-sulfonate) (5 parts). The contents of the vessel were stirred and melted by heating. Heating of the melt was continued to a temperature of 65° C. and guar gum (4 parts) was stirred into the melt which was then allowed to stand at a temperature of 65° C. for a period of 2 hours to provide a thickened melt or first component of a composition of the invention.

Portion (700 parts) of the thickened melt prepared as described above was transferred to a planetary mixer and combined, with mixing, with oiled ammonium nitrate prills (297.4 parts containing 6% w/w adsorbed fuel oil), sodium nitrate (2 parts as a 33.3% w/w aqueous solution) and sodium dichromate (0.6 parts as a 50% w/w aqueous solution).

On completion of the mixing samples were prepared by pouring the composition of the invention into simulated boreholes in the form of cylindrical cardboard tubes having internal diameters of 140, 75 and 63 mm. After cooling to form a solid the density of the composition was 1.1 g/cm$^3$ at 20° C. Each of the samples gave complete detonation using a 140 g pentolite booster with bubble energy yields of 2.0, 1.47 and 1.48 MJ/kg respectively.

EXAMPLE 3

A melt explosive composition of the invention was prepared by mixing the following amounts of ingredients into 750 parts of thickened melt prepared as described in Example 2.

| Component | Parts by Weight |
|---|---|
| oiled ammonium nitrate prills (containing 6% w/w adsorbed fuel oil) | 249.5 |
| sodium dichromate (50% w/w aqueous solution) | 0.5 |

On completion of the mixing a sample of the composition of the invention was poured into a simulated borehole in the form of a cylindrical cardboard tube having an internal diameter of 140 mm. The density of the composition, after cooling to 20° C. was 1.3 g/cm$^3$. The sample gave complete deontation (bubble energy yield 1.66 MJ/kg) when detonated using a 140 g pentolite booster.

EXAMPLE 4

A melt explosive composition of the invention was prepared by mixing the following amounts of ingredients into 500 parts of thickened melt prepared as described in Example 2.

| Component | Parts by Weight |
|---|---|
| oiled ammonium nitrate prills (containing 5.1% w/w adsorbed fuel oil) | 499.4 |
| sodium dichromate (50% w/w aqueous solution) | 0.6 |

On completion of the mixing a sample of the composition of the invention was poured into a simulated borehole in the form of a cylindrical cardboard tube having an internal diameter of 140 mm. The density of the composition after cooling to 20° C. was 1.3 g/cm$^3$. The sample gave complete detonation (bubble energy yield 1.91 MJ/kg) when detonated using a 140 g pentolite booster.

EXAMPLES 5–8

Melt explosive compositions of the invention were prepared following the procedure described in Example 2 with the exception that the amount of sodium nitrite added to the thickened melt was varied to give melt explosive compositions having a range of densities. A sample of each composition of the invention was poured into a simulated borehole in the form of a cylindrical cardboard tube having an internal diameter of 140 mm. Each composition gave complete detonation when detonated using a 140 g pentolite booster. The density of each composition and the bubble energy yield on detonation is recorded in Table 1 below.

TABLE 1

| Example No | Density g/cm$^3$ | Bubble Energy Yield (MJ/kg) |
|---|---|---|
| 5 | 1.01 | 1.97 |
| 6 | 1.24 | 1.89 |
| 7 | 1.31 | 1.65 |

TABLE 1-continued

| Example No | Density g/cm³ | Bubble Energy Yield (MJ/kg) |
|---|---|---|
| 8 | 1.34 | 1.45 |

EXAMPLE 9

A melt explosive composition of the invention was prepared by mixing the following amounts of ingredients into 475 parts of thickened melt prepared as described in Example 2.

| Component | Parts by Weight |
|---|---|
| oiled ammonium nitrate prills (containing 6% w/w adsorbed fuel oil) | 470.9 |
| aluminium powder | 50.0 |
| sodium nitrite (33.3% w/w aqueous solution) | 3.2 |
| sodium dichromate (50% w/w aqueous solution) | 0.9 |

On completion of the mixing a sample of the composition of the invention was poured into a simulated borehole in the form of a cylindrical cardboard tube having an internal diameter of 63 mm. After cooling the density of the composition was 1.1 g/cm³. The sample gave complete detonation (bubble energy yield 1.62 MJ/kg) when detonated using a 140 g pentolite booster.

EXAMPLE 10

A melt explosive composition of the invention was prepared by mixing the following amounts of ingredients into 500 parts of thickened melt prepared as described in Example 2.

| Component | Parts by Weight |
|---|---|
| oiled ammonium nitrate prills (containing 5.1% w/w adsorbed fuel oil) | 496.4 |
| sodium nitrite (33.3% w/w aqueous solution) | 3.0 |
| sodium dichromate (50% w/w aqueous solution) | 0.6 |

On completion of the mixing a sample of the composition of the invention was poured into a simulated borehole in the form of a cylindrical poly(vinyl chloride) tube having an internal diameter of 150 mm. After cooling the density of the sample was 0.99 g/cm³. In order to evaluate the detonation sensitivity of the composition under applied static pressure, a condition encountered in deep boreholes, the sample was subjected to an applied pressure of 150 pounds per square inch and an attempt was made to detonate the sample using a 140 g pentolite booster. The sample gave complete detonation (bubble energy yield 2.14 MJ/kg).

EXAMPLE 11

A melt explosive composition of the invention was prepared by mixing the following amounts of ingredients into 800 parts of thickened melt prepared as described in Example 2.

| Component | Parts by Weight |
|---|---|
| oiled ammonium nitrate prills (containing 6.0% w/w adsorbed fuel oil) | 198.4 |
| sodium nitrite (33.3% w/w aqueous solution) | 1.0 |
| sodium dichromate (50% w/w aqueous solution) | 0.6 |

On completion of the mixing samples of the composition of the invention were poured into a series of simulated boreholes in the form of cylindrical cardboard tubes having internal diameters of 140 mm. After cooling the density of the samples was 1.15 g/cm³. In order to evaluate the detonation sensitivity of the composition on storage, attempts were made to detonate the individual samples after they had been stored for varying lengths of time. The density of the samples did not change appreciably on storage and each sample gave complete detonation when detonated using a 140 g pentolite booster. The age of each sample and the bubble energy yield is recorded in Table 2 below.

TABLE 2

| Age of Sample (days) | Bubble Energy Yield (MJ/kg) |
|---|---|
| 8 | 1.82 |
| 31 | 1.52 |
| 38 | 1.66 |
| 65 | 1.56 |
| 91 | 1.86 |
| 125 | 1.50 |

We claim:

1. A melt explosive composition comprising as a first component a melt which assumes a molten form at a temperature in the range from −10° C. to +90° C. and which comprises at least one oxygen-releasing salt and at least one melt soluble fuel material and a second component comprising prills of ammonium nitrate having oil absorbed thereon.

2. A melt explosive composition according to claim 1 wherein said oxygen-releasing salt is selected from the group consisting of the alkali metal, alkaline earth metal and the ammonium, nitrates, chlorates and perchlorates, and mixtures thereof.

3. A melt explosive composition according to claim 2 wherein said oxygen-releasing salt is selected from the group consisting of ammonium nitrate, sodium nirate, calcium nitrate and mixtures thereof.

4. A melt explosive composition according to claim 3 wherein said oxygen-releasing salt comprises a mixture of ammonium nitrate and sodium nitrate.

5. A melt explosive composition according to claim 1 wherein said melt soluble fuel material is selected from the group consisting of carboxylates, thiocyanates, amines, imides, amides and mixtures thereof.

6. A melt explosive composition according to claim 5 wherein said melt soluble fuel material is selected from the group consisting of urea, ammonium acetate, ammonium formate, ammonium thiocyanate, hexamethylenetetramine, dicyandiamide, thiourea, acetamide and mixtures thereof.

7. A melt explosive composition according to claim 6 wherein said melt soluble fuel material comprises urea.

8. A melt explosive composition according to claim 1 wherein said prills of ammonium nitrate having oil absorbed thereon comprise from 1.0 to 10.0% by weight of an oil.

9. A melt explosive composition according to claim 8 wherein said prills of ammonium nitrate having oil absorbed thereon comprise from 3.0 to 7.0% by weight of an oil.

10. A melt explosive composition according to claim 1 which comprises from 10 to 90% by weight of said first component.

11. A melt explosive composition according to claim 10 which comprises from 40 to 90% by weight of said first component.

12. A melt explosive composition according to claim 1 wherein the total oxygen-releasing salt content comprises from 50 to 90% by weight of said composition.

13. A melt explosive composition according to claim 1 wherein said melt soluble fuel material comprises from 3 to 30% by weight of said composition.

14. A melt explosive composition according to claim 12 wherein the total oxygen-releasing salt content comprises from 70 to 85% by weight of said composition.

15. A melt explosive composition according to claim 13 wherein said melt soluble fuel material comprises from 10 to 25% by weight of said composition.

16. A melt explosive composition according to claim 1 which further comprises at least one naphthalenesulfonate derivative selected from the condensates of formaldehyde and naphthalenesulfonic acids, the condensates of formaldehyde and $C_1$ to $C_{10}$-(alkyl)naphthalenesulfonic acids, and the alkali, and alkaline earth metal salts thereof.

17. A melt explosive composition according to claim 16 wherein said naphthalenesulfonate derivative is selected from the condensates of formaldehyde and naphthalenesulfonic acids and the condensates of formaldehyde and $C_1$ to $C_{10}$-(alkyl)naphthalenesulfonic acids in which two naphthalanesulfonate or $C_1$ to $C_{10}$-(alkyl)-naphthalenesulfonic moieties are joined together by a methylene group, and the alkali metal and alkaline earth metal derivatives thereof.

18. A melt explosive composition according to claim 17 wherein said naphthalenesulfonic derivative is selected from the alkali metal salts of condensates of formaldehyde and naphthalenesulfonic acids.

19. A melt explosive composition according to claim 18 wherein said naphthalenesulfonate derivative comprises an alkali metal salt of methylenebis(naphthalene-$\beta$-sulfonate).

20. A melt explosive composition according to claim 16 wherein said naphthalenesulfonate derivative comprises from 0.01 to 5.0% by weight of said composition.

21. A melt explosive composition according to claim 20 wherein said naphthalenesulfonate derivative comprises from 0.1 to 2.0% by weight of said composition.

22. A melt explosive composition according to claim 1 which further comprises up to 10% by weight of a secondary fuel material selected from the group consisting of carbonaceous materials and finely divided elements.

23. A melt explosive composition according to claim 22 wherein said secondary fuel is aluminium powder.

24. A melt explosive composition accordng to claim 1 which further comprises at least one thickening agent.

25. A melt explosive composition according to claim 24 wherein said thickening agent is crosslinked.

26. A melt explosive composition according to claim 1 which further comprises a discontinuous gaseous phase.

27. A melt explosive composition according to claim 26 wherein said discontinuous gaseous phase comprises gas bubbles.

28. A melt explosive composition according to claim 27 which further comprises a foam stabilizing surfactant to stabilize said gas bubbles.

29. A melt explosive composition comprising: as a first component an eutectic which assumes a molten form at a temperature in the range from −10° C. to +90° C. and which comprises at least one oxygen-releasing salt, at least one melt-soluble fuel material, at least one formaldehyde-naphthalenesulfonate derivative selected from the condensates of formaldehyde and naphthalenesulfonic acids, the condensates of formaldehyde and $C_1$ to $C_{10}$-(alkyl)naphthalenesulfonic acids, and the alkali metal and alkaline earth metal derivatives thereof, a discontinuous gaseous phase comprising gas bubbles and a foam stabilizing surfactant to stabilize said gas bubbles, a thickening agent and a crosslinking agent; and a second component which comprises prills of ammonium nitrate having oil absorbed thereon.

30. A process for the manufacture of a melt explosive composition which comprises as a first component a melt which assumes a molten form at a temperature in the range from −10° C. to +90° C. and which comprises at least one oxygen-releasing salt and at least one melt soluble fuel material and a second component comprising prills of ammonium nitrate having oil absorbed thereon, which process comprises forming a melt comprising said first component and incorporating into said melt said second component.

* * * * *